US006910356B2

(12) United States Patent
Price

(10) Patent No.: US 6,910,356 B2
(45) Date of Patent: Jun. 28, 2005

(54) ANTI-PICK MOGUL CYLINDER

(75) Inventor: Dennis C. Price, Rockport, TX (US)

(73) Assignee: New Security Lock Company, Ltd., Corpus Christi, TX (US)

( * ) Notice: Subject to any disclaimer, the term of this patent is extended or adjusted under 35 U.S.C. 154(b) by 0 days.

(21) Appl. No.: 10/076,947

(22) Filed: Feb. 15, 2002

(65) Prior Publication Data

US 2003/0154752 A1 Aug. 21, 2003

(51) Int. Cl.[7] ..... E05B 27/06; E05B 15/16

(52) U.S. Cl. ..... 70/358; 70/417; 70/419; 70/493

(58) Field of Search ..... 70/358, 417, 419, 70/493–495

(56) References Cited

U.S. PATENT DOCUMENTS

| | | | | | |
|---|---|---|---|---|---|
| 874,808 | A | * | 12/1907 | Taylor | 70/417 |
| 977,085 | A | * | 11/1910 | Eras | |
| 1,140,209 | A | * | 5/1915 | Taylor | |
| 1,422,497 | A | * | 7/1922 | Thompson | |
| 1,422,515 | A | * | 7/1922 | Augenbraun | |
| 2,059,129 | A | * | 10/1936 | Maxwell et al. | |
| 2,104,397 | A | * | 1/1938 | Hurd | |
| 2,754,673 | A | * | 7/1956 | Schachinger | |
| 2,857,753 | A | * | 10/1958 | Biro | |
| RE26,272 | E | * | 9/1967 | Schreiber et al. | |
| 3,500,670 | A | * | 3/1970 | Hawkins | |
| 3,590,615 | A | * | 7/1971 | Schultz | 70/421 |
| 3,768,284 | A | * | 10/1973 | Kent et al. | 70/417 X |
| 3,780,549 | A | * | 12/1973 | Schlage | 70/358 |
| 3,788,110 | A | * | 1/1974 | Sugae | 70/358 |
| 3,981,168 | A | * | 9/1976 | Vanelli Coralli et al. | 70/417 |
| 4,137,739 | A | * | 2/1979 | Keller | 70/358 |
| 4,196,604 | A | * | 4/1980 | Vorob | 70/358 |
| 4,380,163 | A | * | 4/1983 | Reder | 70/378 X |
| 5,079,936 | A | * | 1/1992 | Stefanek | 70/358 |
| 5,475,997 | A | * | 12/1995 | Chung | 70/375 |
| 6,079,240 | A | * | 6/2000 | Shvarts | 70/367 |
| 6,105,404 | A | * | 8/2000 | Field et al. | 70/365 |
| 2002/0116968 | A1 | * | 8/2002 | Shvarts | 70/370 |

FOREIGN PATENT DOCUMENTS

| | | | | |
|---|---|---|---|---|
| CH | 372947 | * | 12/1963 | 70/493 |
| DE | 565385 | * | 11/1932 | 70/417 |
| FR | 1031423 | * | 6/1953 | 70/493 |
| FR | 1538781 | * | 9/1968 | 70/493 |
| FR | 2388966 | * | 12/1978 | 70/417 |
| GB | 1040276 | * | 8/1966 | 70/358 |
| GB | 2154652 | * | 9/1985 | 70/358 |

* cited by examiner

*Primary Examiner*—Lloyd A. Gall
(74) *Attorney, Agent, or Firm*—Kenneth T. Emanuelson; Danamraj & Youst, P.C.

(57) ABSTRACT

The lock cylinder assembly of the present invention incorporates a number of features designed to defeat attempts to pick or destroy the lock. The lock cylinder assembly employs multiple arrays of pass key pins, making picking of the lock much more difficult. Second, the arrangement of the pass key pins in separate arrays requires that multiple cuts would have to be made into the lock housing mogul or cylinder blank in order to defeat the lock cylinder assembly. Third, the lock cylinder assembly of the present invention may incorporate multiple sets of hardened dowel pins to prevent drilling through the lock housing mogul in the area of the driver pins. Fourth, the lock cylinder assembly of the present invention may incorporate a hardened cylinder shield behind the front face of the cylinder blank to prevent drilling through the cylinder blank.

10 Claims, 4 Drawing Sheets

ANTI-PICK MOGUL CYLINDER

BACKGROUND

The use of locks of known designs and configurations are known in the prior art. More specifically, locks of known designs and configurations heretofore devised and utilized for the purpose of minimizing the possibility of opening locks without keys are known to consist basically of familiar, expected, and obvious structural configurations, notwithstanding the myriad of designs encompassed by prior designs which have been developed for the fulfillment of countless objectives and requirements.

By way of example, U.S. Pat. No. 1,414,348 to M. Falk discloses a pin-tumbler lock. U.S. Pat. No. 3,478,549 to E. L. Schlage discloses a pick resistant lock unit. U.S. Pat. No. 3,531,959 to E. Weber discloses a security attachment for cylinder lock. U.S. Pat. No. 4,103,526 to Surko, Jr. discloses a pin tumbler lock. U.S. Pat. No. 4,631,941 to Sjunnesson discloses a cylinder lock with permissible service entry. U.S. Pat. No. 4,953,375, to Tzou discloses an electronically self-latching cylinder lock. U.S. Pat. No. 5,361,614, to Metcalf discloses a pin-tumbler lock with retained key and method of operation thereof. U.S. Pat. No. 5,400,629 to Myers discloses an axial pin tumbler lock. U.S. Pat. No. 5,640,865 to Widen discloses a cylinder lock and key combination. Lastly, U.S. Pat. No. 5,475,997 to Chung discloses a lock assembly.

Most lock mechanisms in use include a housing having a generally cylindrical bore therethrough in which is mounted a revolving cylinder or tumbler. A plurality of biased pins or plungers are provided which cooperate with the housing and the revolving cylinder to enable or inhibit the rotation of the tumbler, the plungers or pins being arranged to detect a suitably coded key which actuates one or more of these plungers or pins. With most commonly used constructions, the revolving cylinder or tumbler is mounted in a through bore of the housing, and the keyhole which accepts the key extends substantially through the revolving cylinder. The pins or plungers are typically arranged along the axis of the tumbler and engage the key as the same is moved into the keyhole.

Structures are generally provided in the lock core for maintaining the pin holes in the core in axial alignment with the pin holes in the cylinder so that the driver pins are free to pass through the shear line between the core and the cylinder and into the cavities holding the follower pins. When a key designed for the lock is inserted into the key slot in the cylinder, the key engages the follower pins and moves them to a position where the abutting faces of the pins lie along the shear line between the core and cylinder, permitting the core to be rotated with respect to the cylinder by rotation of the key.

A problem which exists with most lock cylinders in use today is that the above-described constructions make it possible for the locks to be violated by picking or partially destroying the same. Picking of such locks has been facilitated by the fact that the plungers or pins are arranged in line with the keyhole and, therefore, are readily accessible to one who is skilled in picking such locks. This traditional type of lock can be very susceptible to being picked, or unlocked by unauthorized persons, by inserting a wire, or other elongated instrument, or instruments, which can be manipulated in such a way as to simultaneously place a rotational force on the core of the lock while moving the follower pins, one at a time, into shear alignment with the peripheral surface of the core. The rotational force is necessary in order to capture a follower pin in its shear position while manipulating the other such pins of the lock, until all are in proper alignment to allow the core to be rotated.

Other locks have the decoding pins or plungers situated proximate to the keyhole or to the keyhole opening so that their operation may be destroyed by drilling into one or another portion of the revolving cylinders. Most typically, revolving cylinders of this type may be made inoperative by simply drilling a hole along the axis of the keyhole and thereby destroying the decoding means or the pins and plungers which are arranged to sense the key.

Various attempts have been made to overcome the above-mentioned problems and to minimize the risk of having a lock picked. Some early attempts at overcoming the problem are exemplified in U.S. Pat. Nos. 866,697 and 888,478. In the first mentioned patent, a key was used which had a bifurcated resilient member at one end thereof which was adapted to engage a suitable actuating mechanism within the lock. The portions making up the bifurcated end of the key were slightly spaced from the axis of the key. This lock did not, however, utilize a cylinder of the type commonly used today and did not use pins or plungers. Instead, the lock of this reference utilized a sliding latch arrangement, which did not provide much protection against picking. The bifurcated end of the key was initially compressed by a channel of reduced diameter, which was in turn provided with a pair of slots internally of the lock which permitted the bifurcated end to expand when brought into registry with the slots. At such time, the bifurcated end could engage and actuate the latch mechanism.

U.S. Pat. No. 888,478 was for a lock design which utilized a double key, one portion having a straight shank and the other portion having a curved shank, with both portions being pivotally connected to each other. Before the latch mechanism of this lock could be actuated, it was necessary to insert the key in such a manner so that both straight and curved shank portions engaged respective or cooperating elements within the lock.

Other attempts have been made to produce a pick-proof lock. These have included locks which use a key having a pivoted free end which is adapted to turn or rotate a predetermined angular distance upon full insertion of the key into the lock to engage an element which would not otherwise be engageable by a straight shank. In U.S. Pat. No. 1,596,336, for example, a lock is disclosed which uses a key having a pivoted end member which is initially aligned with the shank of the key in one position thereof. When the key is turned approximately 180 degrees, the pivoted end portion moves, due to gravity, to a position which permits the same to engage a latch. Further rotation of the key causes the latch to move. In order to provide somewhat more control over the action of the key, and more particularly over the pivoted free end thereof, further constructions have been proposed wherein the position of the pivotally mounted free end may be controlled at the exposed end of the key or in the region of the gripping portion thereof. Such constructions are disclosed in U.S. Pat. Nos. 1,464,194 and 1,750,542. In all of these patents, however, the movement of the pivoted end towards the final or operative position only causes the pivoted portion to engage a latch or the like and could not, in and of itself, be utilized with the more modern and more complex locks which are in use today.

Other locks which are known in the prior art include a key which has a pivotally mounted finger thereon, the finger itself being provided with a cam surface which engages an abutment upon insertion of the key into the cylinder to cause the finger to be deflected from its initial axially aligned position to one where the fingers may be displaced approximately 90 degrees from that initial position. In U.S. Pat. Nos. 1,274,313 and 2,296,029, these pivotally mounted fingers engage a latch mechanism in the pivoted or actuating position, while in U.S. Pat. No. 1,567,979, the finger engages a pair of spring-loaded pins or plungers. The last described construction has the disadvantages above described since the spring loaded pins or plungers are mounted substantially in line with the keyhole and, therefore, this allows for the lock to be defeated by simply drilling through the keyhole.

Another such lock is described in U.S. Pat. No. 2,596,720 in which the spring-loaded driver pins are provided with reduced diameter terminations abutting spacer disks or different diameter balls riding on an associated tumbler pin. In accordance with this design, each of the bores of the core are flanked by two relatively shallow recesses, or grooves, extending over a limited arch of the periphery of the barrel, or core, the depth of the grooves increasing toward the extremities remote from each bore to form an abutment. Accordingly, when an attempt is made to pick the lock, the core will begin to rotate as soon as the top of a disk lies flush with its periphery. The end terminations of the driver pins now ride in the grooves, and the maximum angle of rotation, which will be reached after all the tumbler pins have been picked, is fixed by the abutments, which is insufficient to retract a latch controlled by the lock. It can thus be seen that each of the aligned tumbler bores must carry a plurality of relatively small components or elements, some of which must be relied on to carry extreme shear load in the case where an attempt is made to pick the lock.

SUMMARY OF THE INVENTION

As noted above, many traditional lock assemblies have inherent shortcomings in that they are highly susceptible to being "picked" by skilled individuals. There are a number of approaches to lock-picking, but most are built around the idea of imparting a certain level of random motion to the pins while placing a certain level of torque on the lock cylinder. With this approach, pins in the appropriate ("unlocked") positions are often more likely to stay in their appropriate positions, while pins in inappropriate ("locked") positions are slightly freer to move, and are likely to continue doing so under the influence of the applied random motion.

The lock cylinder assembly of the present invention incorporates a number of features designed to defeat attempts to pick or destroy the lock. First, in certain embodiments the lock cylinder assembly employs two or more separate arrays of pass key pins. With this arrangement, a person attempting to pick the lock cylinder assembly would have to contend with all pin arrays simultaneously, rather than only a single pin array as found in many earlier designs. Rotation of the cylinder blank in the cylinder bore can only be performed when all of the pass key pins are properly aligned along the shear lines of the lock cylinder assembly. Placing the pins in separate arrays makes picking of the lock cylinder assembly more difficult as compared to picking of a more traditional lock cylinder assembly having its pass key pins aligned in a single array.

In addition to the advantages described above, certain embodiments of the lock cylinder assembly of the present invention incorporate certain features designed to prevent the defeat of the lock cylinder assembly by destructive means. It is known that traditional lock cylinder assemblies can be defeated through the use of drills or similar metal-cutting tools to either destroy the pass key pins or remove the surrounding material to allow removal of the pass key pins. Certain embodiments of the lock cylinder assembly of the present invention incorporate a number of features designed to thwart the defeat of the lock cylinder assembly through such methods. First, the arrangement of the pass key pins in separate arrays requires that separate cuts be made into the lock housing mogul or cylinder blank in order to defeat the lock cylinder assembly. Second, certain embodiments of the lock cylinder assembly of the present invention incorporate separate sets of hardened dowel pins to prevent drilling through the lock housing mogul in the area of the side driver pins and top driver pins. Third, certain embodiments of the lock cylinder assembly of the present invention incorporate a hardened cylinder shield behind the front face of the cylinder blank to prevent drilling through the cylinder blank in the area of the top pass key pins or the side pass key pins. In certain embodiments of the present invention, the cylinder shield is designed so that the area protected by the cylinder shield partially or completely overlaps the area protected by the dowel pins.

BRIEF DESCRIPTION OF THE DRAWINGS

For a more complete understanding of the features and advantages of the present invention, reference is now made to the detailed description of certain embodiments of the invention along with the accompanying figures in which corresponding numerals in the different figures refer to corresponding parts and in which.

DETAILED DESCRIPTION OF THE INVENTION

While the making and using of various embodiments of the present invention are discussed in detail below with reference to certain contexts, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Figure 1:
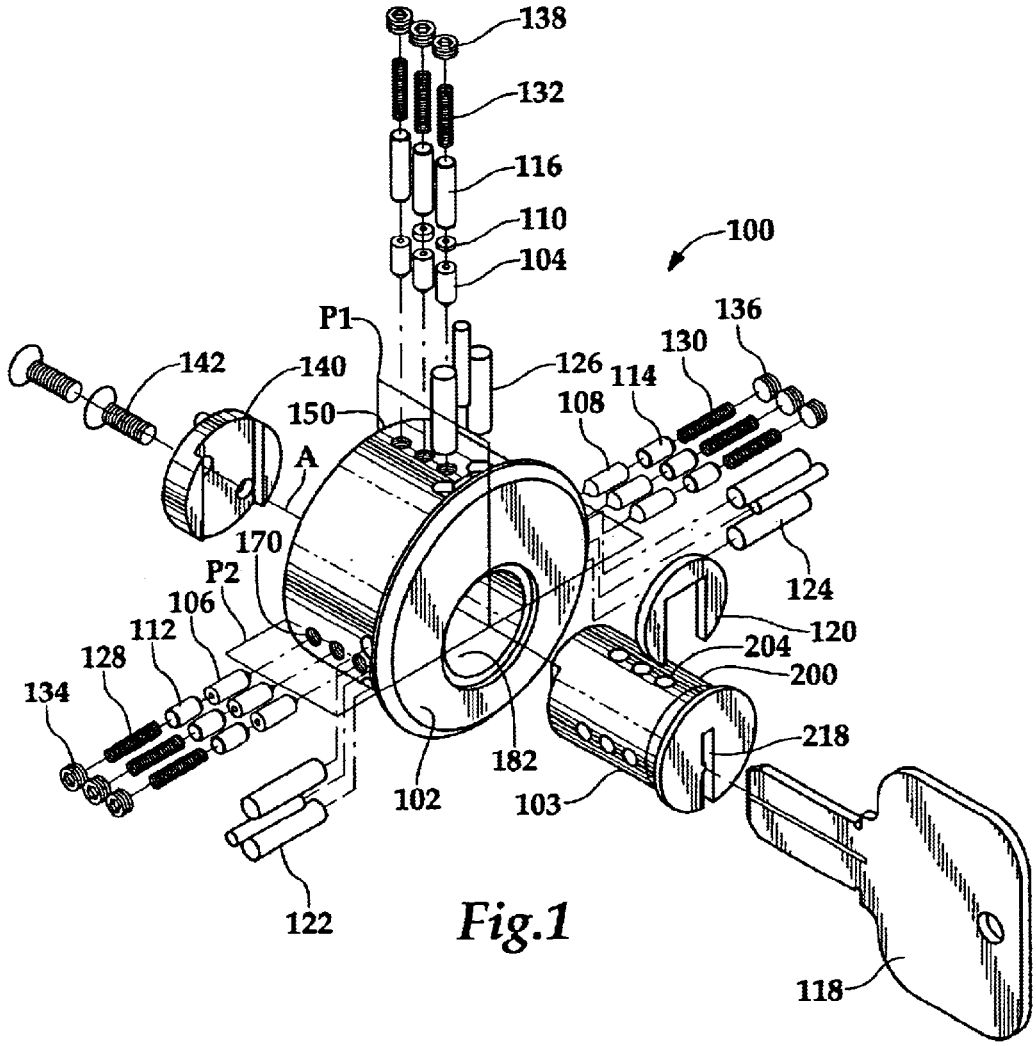
FIG. 1 is an exploded isometric view of a pick-resistant lock assembly according to one embodiment of the present invention.

FIG. 1 is an exploded isometric view of a pick-resistant lock assembly 100 according to one embodiment of the present invention. As can be seen in FIG. 1, pick-resistant lock assembly 100 includes a generally-cylindrical lock housing mogul 102 having a cylindrical bore 182 therethrough having an axis A and being sized to accept a cylinder blank 103. Lock housing mogul 102 has several additional arrays of bores, which include top key pin bore 150 and side key pin bore 170, sized to accept key pins, including top pass key pins 104 and side pass key pins 106 and 108. In the embodiment shown in FIG. 1, each array of key pin bores includes exactly three key pin bores, but alternate embodiments may incorporate more than three key pin bores or fewer than three key pin bores as applications demand. Further, there is no requirement that each array of key pin bores include the same number of key pin bores.

In the embodiment shown in FIG. 1, top key pin bore 150 is aligned with a first plane P1 passing through axis A. Further, side pass key pin bore 170 of FIG. 1 is aligned with a second plane P2 passing through axis A orthogonal to first plane P1. In alternate embodiments, the side pass key pin bore 170 may be aligned with different planes, or may be aligned with a single plane not orthogonal to plane P1 without departing from the spirit and scope of the present invention.

Disposed within each key pin bore, such as key pin bore 150 or 170, there is a pass key pin such as pass key pin 104, 106, or 108. In the embodiment shown in FIG. 1, the tips of the pass key pins 104, 106, and 108 are tapered so as to guide the pass key pins 104, 106, and 108 as they slide across the surface of the mogul key 118, thereby promoting reliable engagement with the keying features on the sides and top of the mogul key 118. The mogul cylinder assembly 100 of FIG. 1 incorporates a set of master key pins 110 behind certain of the pass key pins 104. The master key pins 110 serve to provide more than one unlocking keying combination for the assembly, so that certain "master" keys can be made which are able to unlock a variety of locks.

Disposed within the key pin bores 150 and 170 and behind the pass key pins 104-108 are a set of driver pins, which include side driver pins 112 and 114 and top driver pins 116. With all pass key pins 104–108 and driver pins 112 and 114 installed in the mogul cylinder assembly 100, the pass key pins 104–108 are disposed principally in the cylinder blank 103, while driver pins 112 and 114 are disposed principally in the body of the lock housing mogul 102.

Disposed within the key pin bores 150 and 170 behind each of the driver pins 112 and 114 in the mogul cylinder assembly 100 is a compression spring 128, 130, or 132. Each compression spring 128, 130, or 132 is held captive in the respective key pin bore 150 or 170 by a socket screw 134, 136, or 138. As installed, the compression springs 128, 130, and 132 act to force the driver pins 112 and 114, and therefore the pass key pins 104, 106, and 108, away from the socket screws 134, 136, and 138 and toward the center of the cylinder blank 103.

If the pass key pins 104, 106, and 108 were the exact same length as the bores 204 in the cylinder blank 103, then the mating points between the pass key pins 104–108 and the driver pins 112–116 would be perfectly aligned with the outside surface 200 of the cylinder blank 103, and the cylinder blank 103 could freely rotate within the cylinder bore 182 within the lock housing mogul 102 without the necessity for any key.

In order for the mogul cylinder assembly 100 to function as a keyed lock, it is necessary for at least one of the pass key pins 104, 106, or 108 to have a length different than the depth of the pin bore 204 within which it is disposed. Under this circumstance, a pass key pin 104, 106, or 108 will be recessed within, or will protrude from, the pin bore 204 in which it sits. This recessed or protruding position of the pass key pin 104, 106, or 108 will cause an interference between one of pass key pins 104–108 or one of driver pins 112–116, and the outer surface 200 of cylinder blank 103. Due to this interference, the cylinder blank 103 cannot be rotated within lock housing mogul 102 without shifting the relevant pass key and driver pin within the bores 204 and 150 within which they are disposed so as to align the contact point between the pins with the outer surface 200 of the cylinder blank 103.

Alignment of the contact point between the pass key pins and driver pins with the outer surface 200 of the cylinder blank 200 is normally accomplished with a key, such as mogul key 118, having depressions and/or protrusions along its length patterned to match the pattern of the pass key pins 104–108 within the cylinder blank 103. When such a key 118 is fully inserted into the broach 218 of the cylinder blank 103, the pattern on the key 118 will push the pass key pins 104–108 to appropriate heights to allow for rotation of the cylinder blank 103 within the lock housing mogul 102.

As noted above, many traditional lock assemblies have inherent shortcomings in that they are highly susceptible to being "picked" by skilled individuals. There are a number of approaches to lock-picking, but most are built around the idea of imparting a certain level of random motion to the pins while placing a certain level of torque on the lock cylinder. With this approach, pins in the appropriate ("unlocked") positions are often more likely to stay in their appropriate positions, while pins in inappropriate ("locked") positions are slightly freer to move, and are likely to continue doing so under the influence of the applied random motion.

The lock cylinder assembly 100 of the present invention incorporates a number of features designed to defeat attempts to pick or destroy the lock. First, the lock cylinder assembly 100 employs three separate arrays of pass key pins 104, 106, and 108. With this arrangement, a person attempting to pick the lock cylinder assembly 100 would have to contend with all three pin arrays simultaneously, rather than only a single pin array as found in many earlier designs. As noted above, rotation of the cylinder blank 103 in the cylinder bore 182 can only be performed when all of the pass key pins 104, 106, and 108 are properly aligned along the shear lines of the lock cylinder assembly 100. Placing the pins 104-108 in three separate arrays makes picking of the lock cylinder assembly 100 at least three times as difficult as picking of a more traditional lock cylinder assembly having its pass key pins aligned in a single array.

In addition to the advantages described above, the lock cylinder assembly 100 of the present invention incorporates certain features designed to prevent the defeat of the lock cylinder assembly 100 by destructive means. It is known that traditional lock cylinder assemblies can be defeated through the use of drills or similar metal-cutting tools to either destroy the pass key pins or remove the surrounding material to allow removal of the pass key pins. The lock cylinder assembly 100 of the present invention incorporates a number of features designed to thwart the defeat of the lock cylinder assembly 100 through such methods. First, the arrangement of the pass key pins 104–108 in three separate arrays requires that at least three separate cuts be made into the lock housing mogul 102 or cylinder blank 103 in order to defeat the lock cylinder assembly 100. Second, the lock cylinder assembly 100 of the present invention incorporates three separate sets of hardened dowel pins 122, 124, and 126 to prevent drilling through the lock housing mogul 102 in the area of the side driver pins 112 and 114 and top driver pins 116. Third, the lock cylinder assembly 100 of the present invention incorporates a hardened cylinder shield 120 behind the front face of the cylinder blank 103 to prevent drilling through the cylinder blank 103 in the area of the top pass key pins 104 or the side pass key pins 106 and 108. In certain embodiments of the present invention, the cylinder shield 120 is designed so that the area protected by the cylinder shield 120 partially or completely overlaps the area protected by the dowel pins 122–126.

Figure 2:
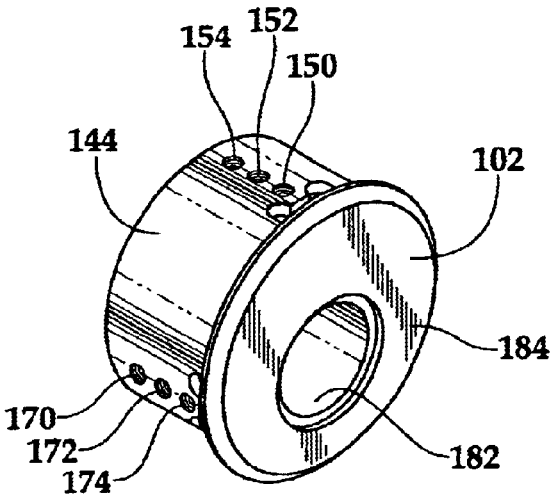
FIG. 2 is an isometric view of a lock housing mogul according to one embodiment of the present invention.
Figure 3:
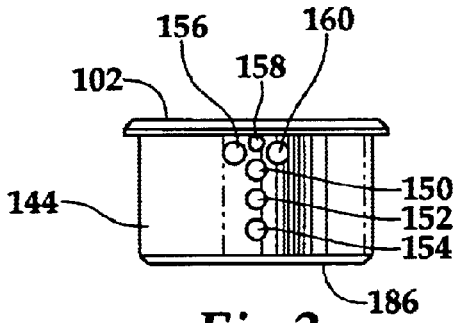
FIG. 3 is a top view of the lock housing mogul of FIG. 2.
Figure 4:
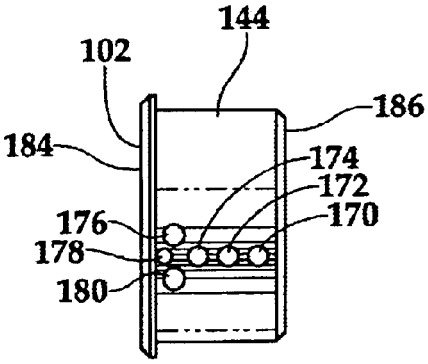
FIG. 4 is a right side view of the lock housing mogul of FIGS. 2 and 3.
Figure 5:
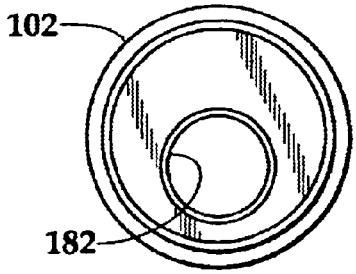
FIG. 5 is a front view of the lock housing mogul of FIGS. 2–4.

FIG. 2 is an isometric view of the lock housing mogul 102 of FIG. 1 according to one embodiment of the present invention. FIG. 3 is a top view of the lock housing mogul 102 of FIGS. 1 and 2. FIG. 4 is a right side view of the lock housing mogul 102 of FIGS. 1–3. FIG. 5 is a front view of the lock housing mogul 102 of FIGS. 1–4.

As seen in FIGS. 2–5, lock housing mogul 102 has a generally-cylindrical shape having an outer surface 144, a cylinder bore 182, a front surface 184, and a rear surface 186. The front surface 184 is part of an escutcheon which extends laterally outwardly of surface 144 as seen in figure 3. In certain embodiments, the lock housing mogul 102 of the present invention may be made of brass, although other suitable materials will be known to those of skill in the art. In one embodiment, the lock housing mogul 102 may have an outside diameter of approximately two inches. Extending radially and upward from the cylinder bore 182 to the outer surface 144 is a series of top driver pin bores 150, 152, and 154. In the lock housing mogul 102 shown in FIGS. 1–5, the top driver pin bores 150–154 are arranged in a line parallel to the principal axis of the lock housing mogul 102, but other embodiments may employ top driver pin bores 150–154 arranged in a staggered arrangement or other non-linear arrangement without departing from the spirit and scope of the present invention.

In the embodiments shown in FIGS. 1–5, a set of top dowel pin bores 156–160 is disposed at the front of the lock housing mogul 102 between the front surface 184 and the top key pin bores 150–154. The top dowel pin bores 156–160 are sized to accept a set of hardened dowel pins 126. Disposed within the lock housing mogul 102 in this manner, the hardened dowel pins 126 block direct access to the top key pin bores 150–154 from the exposed front surface 184 of the lock housing mogul 102 by a drill or other tool. As such, hardened dowel pins 126 will serve to prevent the defeat of the lock cylinder assembly 100 by destructive means. Although lock housing mogul 102 employs three top dowel pin bores 156–160, it will be appreciated by those of skill in the art that alternate embodiments may employ more or fewer than three dowel pin bores 156–160, or may employ one or more hardened plates or other non-cylindrical shapes for accomplishment of the same function as that performed by top dowel pins 126 without departing from the spirit and scope of the present invention.

Extending radially and sidewards from either side of the cylinder bore 182 to the outer surface 144 is a series of side driver pin bores 170, 172, and 174. It will be noted that FIG. 4 shows the left side of the lock housing mogul 102. It will be appreciated by those of skill in the art that the right side of the lock housing mogul 102 is not shown, but is substantially the same as the left side shown in FIG. 4, with the exception that certain embodiments of the present invention employ left and right side pin bore arrays offset to one another.

In the lock housing mogul 102 shown in FIGS. 1–5, the side driver pin bores 170–174 are arranged in two lines parallel to the principal axis of the lock housing mogul 102 on either side of the cylinder bore 182. Other embodiments may employ side driver pin bores 170–174 arranged in a staggered arrangement or other non-linear arrangement without departing from the spirit and scope of the present invention.

In the embodiment shown in FIGS. 1–5, a set of side dowel pin bores 176–180 is disposed at the front of the lock housing mogul 102 between the front surface 184 and the side key pin bores 170–174. The side dowel pin bores 176–180 are sized to accept a set of hardened dowel pins 122 and 124. Disposed within the lock housing mogul 102 in this manner, the hardened dowel pins 122 and 124 block direct access to the side key pin bores 170–174 from the exposed front surface 184 of the lock housing mogul 102 by a drill or other tool. As such, hardened dowel pins 122 and 124 will serve to prevent the defeat of the lock cylinder assembly 100 by destructive means. Although lock housing mogul 102 employs two sets of three side dowel pin bores 176–180, it will be appreciated by those of skill in the art that alternate embodiments may employ more or fewer than three dowel pin bores 176–180, or may employ one or more hardened plates or other non-cylindrical shapes for accomplishment of the same function as that performed by top dowel pins 122 and 124 without departing from the spirit and scope of the present invention.

Figure 6:
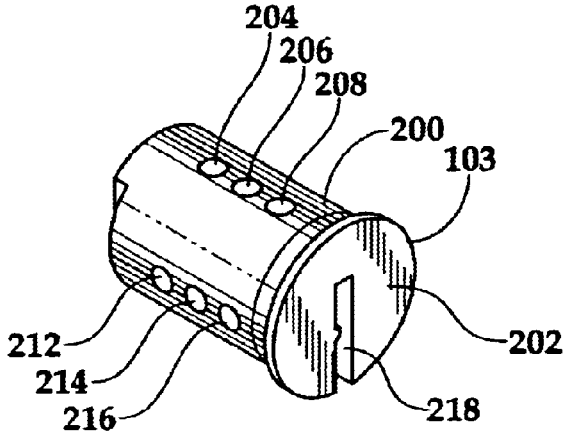
FIG. 6 is an isometric view of a cylinder blank according to one embodiment of the present invention.
Figure 7:
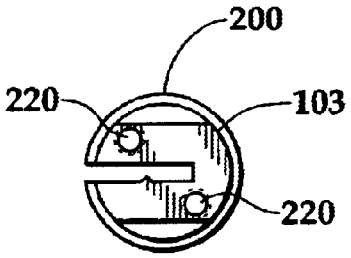
FIG. 7 is a rear view of the cylinder blank of FIG. 6.
Figure 8:
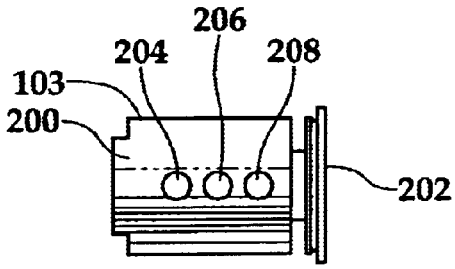
FIG. 8 is a side view of the cylinder blank of FIGS. 6 and 7.

FIG. 6 is an isometric view of a cylinder blank 103 according to one embodiment of the present invention. FIG. 7 is a rear view of the cylinder blank 103 of FIG. 6. FIG. 8 is a side view of the cylinder blank 103 of FIGS. 6 and 7. In certain embodiments, the cylinder blank 103 may be made of brass, but it will be appreciated by those of skill in the art that a range of materials may be suitable for this purpose. As seen in FIGS. 6–8, cylinder blank 103 has a generally-cylindrical shape having an outer surface 200 and a front surface 202. A broach 218 passes through cylinder blank 103 from the front surface 202 along the principal axis of the cylinder blank 103. The broach 218 has a uniform cross-section shaped to receive the mogul key 118 of FIG. 1. Cylinder blank 103 incorporates threaded holes 220 to facilitate securement of the cylinder blank 103 within the lock housing mogul 102 and to facilitate attachment of a cam or other latching mechanism to the cylinder blank 103.

Extending radially and upward from the broach 218 to the outer surface 200 is a series of top pass key pin bores 204, 206, and 208. In the cylinder blank 103 shown in FIGS. 6–8, the top pass key pin bores 204–208 are arranged in a line parallel to the principal axis of the cylinder blank 103, but other embodiments may employ top pass key pin bores 204–208 arranged in a staggered arrangement or other non-linear arrangement without departing from the spirit and scope of the present invention.

Extending radially and sidewards from either side of the broach 218 to the outer surface 200 is a series of side pass key pin bores 212, 214, and 216. It will be noted that FIG. 8 shows the left side of the cylinder blank 103. It will be appreciated by those of skill in the art that the right side of the cylinder blank 103 is not shown, but is substantially the same as the left side shown in FIG. 8, with the exception that certain embodiments of the present invention employ left and right side pin bore arrays offset to one another.

In the cylinder blank 103 shown in FIGS. 6–8, the side pass key pin bores 212–216 are arranged in two lines parallel to the principal axis of the cylinder blank 103 on either side of the broach 218. Other embodiments may employ side pass key pin bores 212–216 arranged in a staggered arrangement or other non-linear arrangement without departing from the spirit and scope of the present invention.

Figure 9:
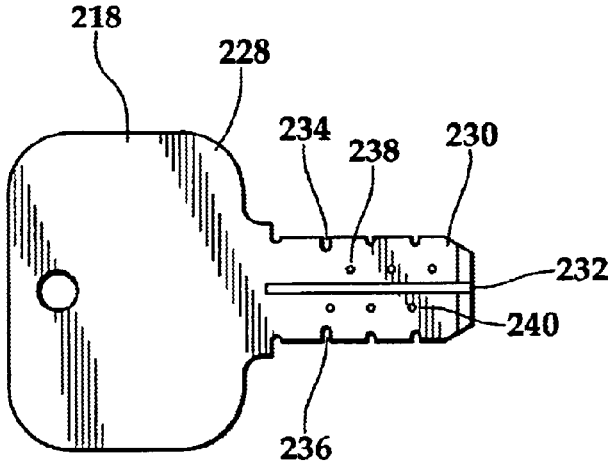
FIG. 9 is a side view of a mogul key blank according to one embodiment of the present invention.

FIG. 9 is a side view of a mogul key 118 according to one embodiment of the present invention. As seen in FIG. 9, mogul key 118 includes a key body 228 connected to a key shank 230 sized and shaped to be inserted into broach 218 of cylinder blank 103. In certain embodiments, key shank 230 may incorporate one or more features such as slot 232 to aid in alignment of key shank 230 within broach 218.

Mogul key 118 shown in FIG. 9 is designed to unlock mogul cylinder assembly 100 in multiple orientations. Specifically, mogul key 118 will interact with the key pins 104–108 of the mogul cylinder assembly 100 in the same manner even if it is flipped 180 degrees about the principal axis of the key shank 230.

When fully inserted into broach 218 of cylinder blank 103, shank mogul key 118 interfaces with pass key pins 104–108 through an array of cuts 232–240 machined into the surface of key shank 230. Each of the cuts 234–240 is machined to a certain depth corresponding to the length of the pass key pin with which it interfaces. A longer pass key pin corresponds to a deeper cut, and a shorter pass key pin corresponds to a shallower cut.

Specifically, pass key pins 104 seat into top cuts 234, and pass key pins 106 and 108 seat into right upper side cuts 238 and left upper side cuts (not shown). As mentioned above, the mogul key 218 can be inverted about its principal axis and used in the same manner, in which case pass key pins 104 would seat into bottom cuts 236, and pass key pins 106 and 108 would seat into right lower side cuts 240 and left lower side cuts (not shown).

One advantage to the use of a symmetrical mogul key is that, should one portion of the mogul key become damaged or worn, the remaining portion may still be used effectively. Furthermore, the symmetry of the key provides that each set of cuts may experience only half as much wear as such features would if redundant features were not provided.

Whereas the invention has been shown and described above in connection with the preferred embodiment thereof, it will be understood that many modifications, substitutions and additions may be made which are within the intended broad scope of the appended claims. The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

What is claimed is:

1. A mogul cylinder assembly comprising:

a generally-cylindrical lock housing mogul having a front surface and a principal axis and having a cylinder bore disposed therein having a principal axis parallel to, and offset from, the principal axis of the lock housing mogul and an inner surface, a first driver pin bore extending radially from, and orthogonal to, the principal axis of the cylinder bore, a second driver pin bore extending radially from, and orthogonal to, the principal axis of the cylinder bore and orthogonal to the first pin bore, and a third driver pin bore extending radially from, and orthogonal to, the principal axis of the cylinder bore, wherein the first driver pin bore is disposed counter-clockwise from the second driver pin bore radially about the principal axis of the cylinder bore and the third driver pin bore is disposed clockwise from the second driver pin bore radially about the principal axis of the cylinder bore;

a cylinder blank disposed within the cylinder bore and having a principal axis aligned to the principal axis of the cylinder bore, a first pass key pin bore aligned to the first driver pin bore of the lock housing mogul, a second pass key pin bore aligned to the second driver pin bore of the lock housing mogul, and a third pass key pin bore aligned to the third driver pin bore of the lock housing mogul;

a first driver pin disposed within the first driver pin bore;

a first pass key pin, having a conical shaped end, disposed within the first pass key pin bore;

a second driver pin disposed within the second driver pin bore; and a second pass key pin, having a conical shaped end, disposed within the second pass key pin bore; a first hardened dowel pin disposed between the first driver pin bore and an escutcheon of the lock housing mogul and a second hardened dowel pin disposed between the escutcheon and the first driver pin bore and axially and laterally staggered relative to the first dowel pin.

2. The mogul cylinder assembly of claim 1 wherein at least one of the first and second driver pin bores includes an internally-threaded portion having a socket screw disposed therein.

3. A mogul cylinder assembly comprising:

a generally-cylindrical lock housing mogul having a front surface and a principal axis and having a cylinder bore having a principal axis parallel to and offset from the principal axis of the lock housing mogul, a principal central plane, having a first side and a second side, aligned to the principal axis of the lock housing mogul and the principal axis of the cylinder bore, and an inner surface, a first set of one or more driver pin bores, disposed on a first side of the principal central plane, aligned with a first set of one or more driver pin axes aligned to a first driver pin plane extending radially from the principal axis of the cylinder bore, a second set of one or more driver pin bores extending radially from the principal axis of the cylinder bore and not parallel to the first driver pin plane, and a third set of one or more driver pin bores, disposed on a second side of the principal central plane and extending radially from the principal axis of the cylinder bore, each aligned to a third driver pin plane not parallel to any of the driver pin bores in the second set of driver pin bores;

a cylinder blank disposed within the cylinder bore and having a principal axis aligned to the principal axis of the cylinder bore, a first set of pass key pin bores each aligned to one of the driver pin bores in the first set of driver pin bores of the lock housing mogul, a second set of pass key pin bores each aligned to a driver pin bore in the second set of one or more driver pin bores in the lock housing mogul, and a third set of pass key pin bores each aligned to a driver pin bore in the third set of driver pin bores in the lock housing mogul;

a first set of driver pins, each disposed within one of the driver pin bores in the first set of driver pin bores;

a first set of pass key pins, each having a conical shaped end and disposed within one of the pass key pin bores in the first set of pass key pin bores;

a second set of one or more driver pins, each disposed within the second set of driver pin bores; and a second set of one or more pass key pins, each having a conical shaped end and disposed within one of the second set of pass key pin bores; a first hardened dowel pin disposed between the first set of driver pin bores and an escutcheon of the lock housing mogul, a second hardened dowel pin disposed between the escutcheon and the first driver pin bores and axially and laterally staggered relative to the first dowel pin; and a hardened shielding device having the shape of a disk having a rectangular cutout therein disposed between the first set of pass key pin bores and the front surface of the cylinder blank.

4. The mogul cylinder assembly of claim 3 wherein the first set of driver pin bores is aligned with a first plane passing through the principal axis of the cylinder bore and at least one of the bores in the second set of driver pin bores is disposed 90 degrees to the first plane radially about the principal axis of the cylinder bore.

5. The mogul cylinder assembly of claim 3 wherein the first and third planes are aligned with the principal axis of the cylinder bore, and the first and third planes are disposed to either side of one of the bores in the second set of driver pin bores radially about the principal axis of the cylinder bore by the same angle.

6. The mogul cylinder assembly of claim 3 further comprising one or more hardened dowel pins disposed between the second set of driver pin bores and the front surface of the lock housing mogul.

7. A mogul cylinder assembly comprising:

a generally-cylindrical lock housing mogul having a front surface and a principal axis and having a cylinder bore having a principal axis parallel to and offset from the principal axis of the lock housing mogul and an inner surface disposed therein, a first set of driver pin bores, each having a threaded portion, aligned with a first driver pin plane extending radially from the principal axis of the cylinder bore, a second set of one or more driver pin bores, each having a threaded portion, aligned with a second driver pin plane extending radially from the principal axis of the cylinder bore radially offset from the first driver pin plane, and a third set of one or more driver pin bores, each having a threaded portion, aligned with a third driver pin plane extending radially from the principal axis of the cylinder bore radially offset from the first and second driver pin planes;

a cylinder blank disposed within the cylinder bore and having a principal axis parallel to and offset from the principal axis of the lock housing mogul, a first set of pass key pin bores each aligned to one of the driver pin bores in the first set of driver pin bores of the lock housing mogul, a second set of pass key pin bores each aligned to one of the driver pin bores in the second set of driver pin bores of the lock housing mogul, and a third set of pass key pin bores each aligned to one of the driver pin bores in the third set of driver pin bores of the lock housing mogul;

a first set of driver pins, each disposed within one of the driver pin bores in the first set of driver pin bores;

a first set of pass key pins, each having a conical end and disposed within one of the pass key pin bores in the first set of pass key pin bores;

a second set of driver pins, each disposed within one of the driver pin bores in the second set of driver pin bores;

a second set of pass key pins, each having a conical end and disposed within one of the pass key pin bores in the second set of pass key pin bores;

a third set of driver pins, each disposed within one of the driver pin bores in the third set of driver pin bores; and a third set of pass key pins, each having a conical end and disposed within one of the pass key pin bores in the third set of pass key pin bores;

a first hardened dowel pin disposed between the first set of driver pin bores and the front surface of the lock housing mogul on a first side of the first driver pin plane, a second hardened dowel pin disposed between the first set of driver pin bores and the front surface of the lock housing mogul on a second side of the first driver pin plane, and a third hardened dowel pin disposed between the first and second hardened dowel pins and aligned to the first driver pin plane wherein the three dowel pins are positioned between an escutcheon of the mogul and the first set of driver pin bores; and a hardened shielding device having the shape of disk having a rectangular cutout therein disposed between the first set of pass key pin bores and the front surface of the cylinder blank.

8. The mogul cylinder assembly of claim 7 further comprising one or more hardened dowel pins disposed between the first and second set of driver pin bores and the front surface of the lock housing mogul.

9. The mogul cylinder assembly of claim 7 wherein the first, second, and third sets of pass key pins are protected by the hardened cylinder shield.

10. The mogul cylinder assembly of claim 7 wherein each of the first, second, and third sets of driver pins are protected by one or more hardened dowel pins disposed between the driver pin bores and the front surface of the lock housing mogul.

* * * * *